US005165208A

United States Patent [19]

Lingemann

[11] Patent Number: 5,165,208

[45] Date of Patent: Nov. 24, 1992

[54] HOLLOW SASH SECTION FOR INSULATION GLAZING OR MUNTIN

[75] Inventor: Horst Lingemann, Wuppertal, Fed. Rep. of Germany

[73] Assignee: Helmut Lingemann GmbH & Co., Fed. Rep. of Germany

[21] Appl. No.: 619,130

[22] Filed: Nov. 27, 1990

[51] Int. Cl.[5] ..... E06B 3/00

[52] U.S. Cl. ..... 52/456; 52/656; 52/781; 52/790; 52/720; 52/738; 29/463

[58] Field of Search ..... 52/720, 731, 738, 455, 52/456, 457, 656, 475, 781, 790, 821, 822, 823; 29/463, 897.31, 897.32, DIG. 48, 469; 228/152, 158

[56] References Cited

U.S. PATENT DOCUMENTS 1,104,868 7/1914 Bolin ..... 52/455

4,400,860 8/1983 Nonnenman et al. ..... 29/157 R

*Primary Examiner*—David A. Scherbel

*Assistant Examiner*—Robert Canfield

*Attorney, Agent, or Firm*—Amster, Rothstein & Ebenstein

[57] ABSTRACT

The invention relates to a hollow sash muntin section (11) of metal, in particular aluminum, for insulation glazing, with a longitudinal welding seam (12*a*) invisibly disposed in a recess (8) in the section.

12 Claims, 1 Drawing Sheet

HOLLOW SASH SECTION FOR INSULATION GLAZING OR MUNTIN

Figure 1:
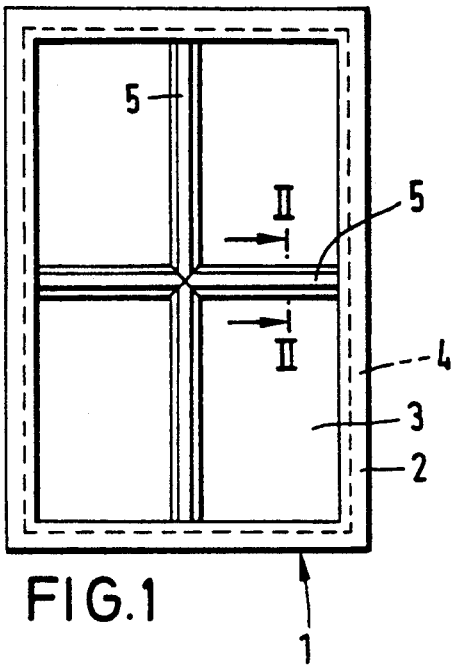

The invention relates to a hollow sash or muntin section of metal, in particular aluminum, for insulation glazings and to a method for the manufacture of the hollow sash section.

Sashes in insulation glazings are arranged between two glass panes, such as of windows. The sashes consist of hollow profile rods joined together such as by cross connecting pieces and being in connection with the spacer frame of the insulation glazing by means of connecting plugs. The sashes are either of the metal color or they are paint coated, with the sash color usually matching the color of the window frame.

In one known method for the manufacture of a sash, a hollow section rod is extruded as a closed section. This manufacturing method necessitates a relatively thick wall of the hollow section rod because thin wall thicknesses cannot be extruded at a justifiable cost. Consequently, relatively much material is needed for such a sash. Another disadvantage is that coating the hollow section rod externally is expensive because the coating can be applied only after the profiling operation.

In another known method for the manufacture of a sash, a hollow section rod with a gap at the joint is formed from a metal band, which gap is then closed by welding. In a sash produced by this method, the welding seam is visible on the surface, which is optically unsightly. While the welding seam can be made invisible by applying a coating, the subsequent coating operation is just as costly as in the case of the extruded hollow sash sections. In addition, the paint consumption is high because the coating must cover the welding seam so that the welding seam becomes invisible. Applying paint before the welding operation is impossible because the paint in the welding seam area would burn off during the welding operation, rendering the hollow section unsightly.

The object of the invention is to provide, in simple manner, metal-colored and paint-coated hollow sash sections with welding seam, in which the welding seam has no disturbing effect and which are relatively resistant to bending and torsion despite their thin wall thickness.

These problems are solved by preferred embodiments of the present invention.

In the hollow sash section according to the invention the joint gap or the welding seam, respectively, is located in a recess in the interior of the hollow section. This causes the joint gap or welding seam to disappear from the surface. In addition, the recess in the section according to the invention increases the bending strength and particularly the torsion strength of the section.

One special advantage of the invention is that the metal band can be subjected to a surface treatment, in particular a surface coating with paint or to an anodizing operation before it is formed into a hollow section rod. Consequently, it is possible to produce the hollow section rod or the sash from an already surface-treated or surface-coated metal band. Such a surface treatment or surface coating can be applied to a band more easily, quickly and cost effectively than to a hollow section rod.

Another advantage of the invention is that the welding seam can be made better welded through and thus wider and stronger. The welding seam may even be rough because it is sunk so far into the recess in the section that it is not visible. Beyond this, it may even be provided not to produce a through welding seam, but to spot weld instead or weld in sections only, which may reduce manufacturing costs considerably.

Figure 2:
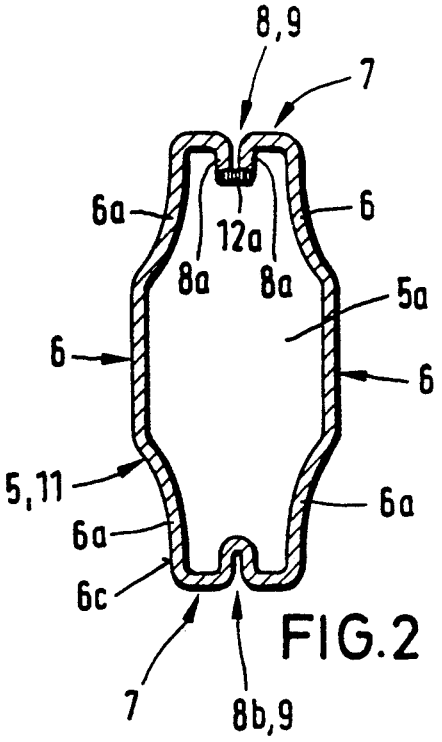
Figure 3:
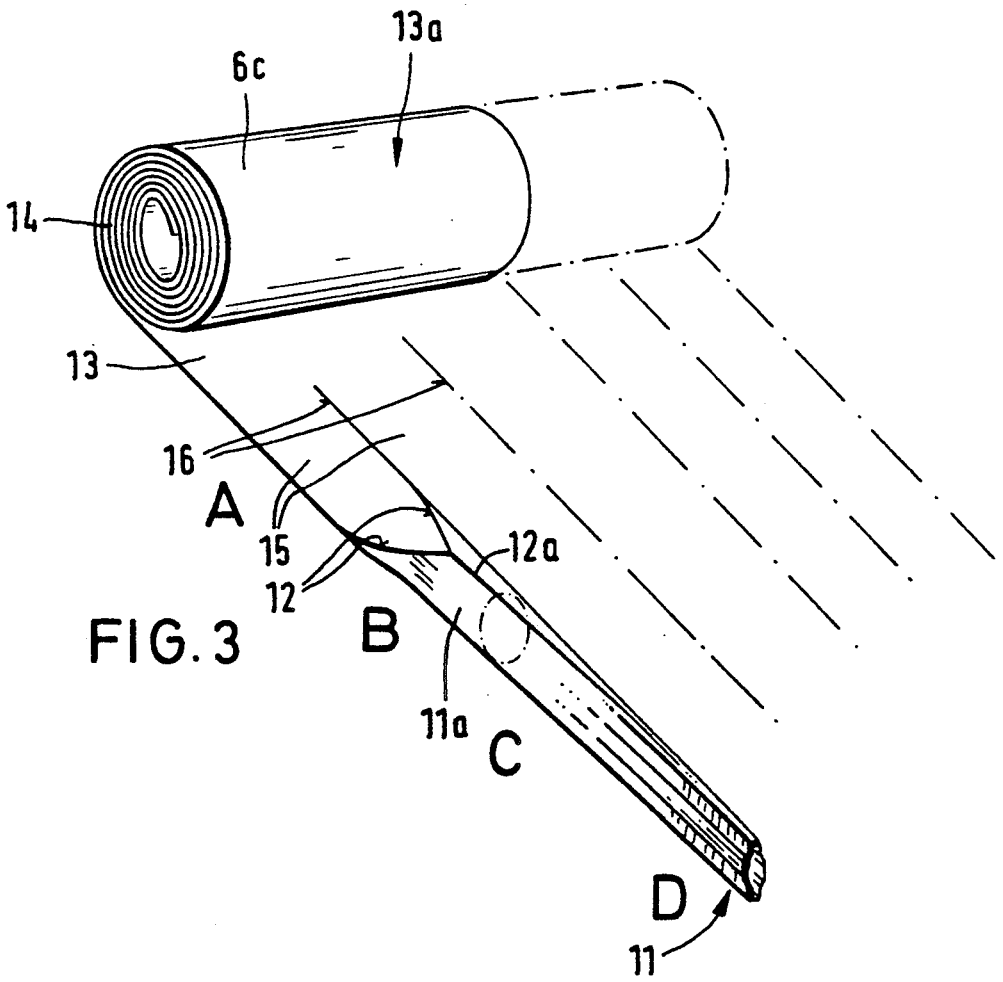

Advantageous further developments of the invention are characterized in the sub-claims. The invention is explained in greater detail in the following with reference to the drawing in which FIG. 1 shows, schematically, a window with insulation glazing in front view;

FIG. 2 a section along line II—II in FIG. 1, enlarged;

FIG. 3 schematically, the production of the hollow sash section from a wide sheet metal coil, in perspective view.

In FIG. 1 is shown a window 1 with insulation glazing. But the invention relates not only to sashes for sash windows, but also to sashes for insulation glazings.

Generally, a window 1 with insulation glazing has a window frame 2, at least two mutually spaced glass panes 3 mounted in the window frame 2, and a spacing frame 4 which keeps the glass panes 3 spaced relative to each other and is filled with desiccant. Sashes or muntins 5 are disposed in the space between the glass panes 3. The sashes 5 consist of metallic hollow section rods with a longitudinal welding seam 12*a*, joined together to form a cross structure. At the points of intersection, the sashes are put together in known manner by means of cross connecting pieces (not shown).

As already mentioned, the sash 5 consists preferably of aluminum. The wall thickness of the sash amounts to about 0.4 to 0.6 mm, in particular. The outside sureface of the sash preferably carries a coat of paint 6*c*, or it is anodized.

One especially simple method to produce a hollow section rod 11 follows from FIG. 3. The raw material is a relatively wide metal band 13 which is pulled off a wide sheet metal coil 14. The metal band 13 consists e.g. of aluminum and carries on its outside 13*a* a relatively thin coat of paint 6*c*.

While being pulled off, the metal band 13 is first cut lengthwise into several strips 15 from which, preferably at the same time, hollow section rods 11 each are formed, e.g. by roll forming and/or stamping. However, the strips 15 may also be coiled up and processed further later on. The hollow sections 11 formed from the strips 15 may be of the same or of different cross-sectional shapes. Likewise, the strips 15 may be of the same or of different widths.

Dividing the metal band 13 into several strips 15 by making longitudinal cuts 16 is done in a processing station A through which the metal band 13 passes as it is pulled off the coil. Behind the processing station A in pull-off direction is a processing station B with forming tools (not shown) in which the strip 15 is formed e.g. into a tube 11*a* of round cross-section, its long edges 12 abutting each other. In this process, the coat of paint 6*c* is on the outside diameter of the tube. In a processing station C which follows the processing station B and contains a welding apparatus, the longitudinal edges 12 are welded together, preferably laser welded, to form a welding seam 12*a*. Behind the processing station C is a processing station D with forming tools (not shown) by means of which the recesses 8, 8*b* are formed into the section and, simultaneously or subsequently, also the profiling of the sidewalls 6, 6*a* and face walls 7.

During the welding operation, the paint burns in the area of the welding seam 12*a*. Due to the recess in the section according to the invention, located in the welding seam area, the welding seam itself as well as the paint areas affected by the welding heat are hidden in the channel 9 so that they remain invisible from the outside. What this unusual measure achieves is that hollow sections formed and welded from a coated metal band can be used as sashes without the welding seam and the partially burned paint areas being disturbing optically. But even when uncoated metal bands are used, sashes can be formed whose welding seam is hidden and has no optically disturbing effect.

The hollow section rods 11 produced continuously are cut to suitable commercal lengths and are available as semiproduct to the manufacturer of insulation glazing. The manufacturer cuts the sashes 5 to length from the hollow section rod 11 and forms the desired sash configuration for his insulation windows.

Thus, the invention teaches to provide at least one recess in the section to make a welding seam invisible and suggests for optical reasons to provide at least one other recess in mirror image to the section recess containing the welding seam. The welding seam need not be situated at a face. It can rather also be e.g. on a side wall if the optical requirements of the sash section so permit.

I claim:

1. Insulation glazing with a hollow sash section of metal with a recess, at least one other recess, and a longitudinal welding seam for insulation glazing, said section having two side walls arranged parallel to each other and two face walls extending transversely thereto; characterized in that said welding seam is disposed in said recess so as to be hidden from view, said at least one other recess is in mirror image on the opposite side of said section, said recesses being disposed centrally along the face walls and being channels of V-shape in cross-section, said welding seam being located in the bottom area of said channels, and said channels defining mutually opposite side walls arranged so as to be in mutual contact.

2. The insulation glazing of claim 1 wherein said section has a coating on its outside surface.

3. The insulation glazing of claim 1 wherein said section is formed of aluminum and has an anodized outside surface.

4. A hollow muntin section of metal with a recess with a longitudinal welding seam for insulation glazing, characterized in that the welding seam is disposed in said recess in the section so as to be hidden from view.

5. A hollow sash section according to claim 4, characterized by at least one other recess (8*b*) in the section in mirror image on the opposite side of the hollow muntin section.

6. A hollow muntin section according to claim 5, the hollow section having two side walls (6) arranged parallel to each other and two face walls (7) extending transversely thereto, characterized in that the recesses (8, 8*b*) in the section are disposed centrally along the face walls (7).

7. A hollow sash section according to claim 5, characterized in that the recesses (8, 8*b*) in the section are channels (9, 9*a*) of U shape in cross-section, the welding seam (12*a*) being located in the bottom area of the channels (9).

8. A hollow muntin section according to claim 7, characterized in that the channels define mutually opposite side walls (8*a*) arranged so as to be in mutual contact.

9. A hollow muntin section according to claim 4, characterized in that the outside surface of the hollow muntin section is coated, in particular paint coated.

10. A hollow muntin section according to claim 4, characterized in that it consists of aluminum and that its outside surface is anodized.

11. A hollow muntin section according to claim 4 characterized in that said metal is aluminum.

12. A hollow sash section according to claim 5, characterized in that the recesses in the section are channels of V shape in cross-section, the welding seam being located in the bottom area of the channels.

* * * * *